US008887630B2

(12) United States Patent
Izume

(10) Patent No.: US 8,887,630 B2
(45) Date of Patent: Nov. 18, 2014

(54) MACHINE-PLATE MOUNTING DEVICE FOR PRINTER, AND PRINTER

(76) Inventor: Masayuki Izume, Kyoto (JP)

( * ) Notice: Subject to any disclaimer, the term of this patent is extended or adjusted under 35 U.S.C. 154(b) by 231 days.

(21) Appl. No.: 12/737,528

(22) PCT Filed: May 21, 2009

(86) PCT No.: PCT/JP2009/059313

§ 371 (c)(1),
(2), (4) Date: Jan. 21, 2011

(87) PCT Pub. No.: WO2010/018702

PCT Pub. Date: Feb. 18, 2010

(65) Prior Publication Data

US 2011/0120332 A1 May 26, 2011

(30) Foreign Application Priority Data

Aug. 11, 2008 (JP) ..... 2008-206539

(51) Int. Cl.
*B41F 27/00* (2006.01)
*B41F 27/10* (2006.01)

(52) U.S. Cl.
CPC ..... *B41F 27/105* (2013.01); *B41P 2227/21* (2013.01)
USPC ..... 101/382.1; 101/383; 101/378

(58) Field of Classification Search
USPC ..... 101/382.1, 383, 286, 385, 378, 388
See application file for complete search history.

(56) References Cited

U.S. PATENT DOCUMENTS 5,168,808 A 12/1992 Prem (Continued)

FOREIGN PATENT DOCUMENTS

DE 2948488 A1 6/1981
JP 5-064873 A 3/1993

(Continued)

OTHER PUBLICATIONS

European Search Report dated May 7, 2012, issued for the corresponding European Patent Application No. 09 80 6598.0.

(Continued)

*Primary Examiner* — Matthew G Marini
(74) *Attorney, Agent, or Firm* — Edwards Wildman Palmer LLP; James E. Armstrong, IV; George N. Chaclas

(57) ABSTRACT

The present invention provides a machine-plate mounting device for a printer which can attach a cylindrical machine plate to the printer more easily and accurately. A machine-plate mounting device 3 is fixedly provided on a machine-plate drive shaft 1 of the printer for mounting a machine plate 2 having a form area 5 provided on a portion of an outer circumferential surface of a machine plate body 4 formed from an elastic material into a cylindrical shape and an engagement portion 6 projecting radially inward from an inner circumference of the machine plate body 5 and extending in an axial direction. The machine-plate mounting device 3 includes a machine-plate cylinder section 12 fixedly provided on the machine-plate drive shaft 1 and having, on its outer circumference, a cylindrical machine-plate mounting surface 14 on which the machine plate 2 is mounted from a front-end side of the machine-plate drive shaft 1. The machine-plate mounting device 3 is configured such that the machine-plate cylinder section 12 has, on its outer circumference, a groove 21 for circumferential positioning into which the engagement portion 6 of the machine plate 2 is fitted from the front-end side of the machine-plate drive shaft 1, a stopper 20 for axial positioning with which an end portion of the machine plate 2 comes into contact, and a machine-plate fixation member 24 which presses a portion, other than the form area 5, of the machine plate 2 mounted on the machine-plate cylinder section 12 from a radial inside direction toward a radial outside direction so as to bring the machine plate 2 into fixed-close contact with the machine-plate mounting surface 14 of the machine-plate cylinder section 12.

14 Claims, 6 Drawing Sheets

(56) References Cited

U.S. PATENT DOCUMENTS

| | | | | |
|---|---|---|---|---|
| 5,188,031 | A * | 2/1993 | Depa et al. | 101/415.1 |
| 5,666,600 | A * | 9/1997 | Kamprath et al. | 399/165 |
| 5,687,647 | A | 11/1997 | Vrotacoe et al. | |
| 6,164,205 | A * | 12/2000 | Metrope | 101/415.1 |
| 6,357,354 | B1 * | 3/2002 | Dauer et al. | 101/477 |
| 6,375,354 | B1 | 4/2002 | Polkus et al. | |
| 6,729,235 | B2 * | 5/2004 | Kerr | 101/415.1 |
| 2002/0011166 | A1 * | 1/2002 | Kanda | 101/415.1 |

FOREIGN PATENT DOCUMENTS

| | | | |
|---|---|---|---|
| JP | 08-001904 | A | 1/1996 |
| JP | 2000-103036 | | 4/2000 |
| JP | 2000-508983 | | 7/2000 |
| JP | 2009-285861 | A | 12/2009 |

OTHER PUBLICATIONS

International Search Report for PCT/JP2009/059313 issued Jun. 23, 2009.

* cited by examiner

MACHINE-PLATE MOUNTING DEVICE FOR PRINTER, AND PRINTER

TECHNICAL FIELD

The present invention relates to a machine-plate mounting device for a printer and to a printer.

BACKGROUND ART

There is known a printer in which a machine plate is mounted on the outer circumference of a machine plate cylinder fixed on a machine-plate drive shaft.

SUMMARY OF THE INVENTION

Problems to be Solved by the Invention

In the above-mentioned printer, a sheet-like machine plate may be wound onto a machine-plate cylinder fixed on a machine-plate drive shaft. In such a case, mounting the machine plate within the printer is troublesome, and difficulty is encountered in accurately attaching the machine plate to the machine-plate cylinder.

In order to avoid such difficulty, the sheet-like machine plate may be wound onto the machine-plate cylinder while the machine-plate cylinder is detached from the machine-plate drive shaft, followed by fixation of the machine-plate cylinder on the machine-plate drive shaft. In this case, since the machine-plate cylinder is considerably heavy, difficulty is encountered in detaching and attaching the machine-plate cylinder from and to the machine-plate drive shaft.

The inventor of the present invention has proposed a machine plate for a printer which solves the above-mentioned problem and enables simple, accurate attachment of the machine plate to a printer; specifically, a machine plate having a forme area provided on a portion of the miter circumferential surface of a machine plate body which is formed from an elastic material into a cylindrical shape, and an engagement portion projecting radially inward from the inner circumference of the machine plate body and extending in the axial direction (Japanese Patent Application No. 2008-137766).

An object of the present invention is to provide a machine-plate mounting device for a printer which can attach a cylindrical machine plate as mentioned above to the printer more easily and accurately, as well as a printer.

Means for Solving the Problem

The present invention provides a machine-plate mounting device for a printer which is fixedly provided on a machine-plate drive shaft of the printer for mounting a machine plate having a forme area provided on a portion of an outer circumferential surface of a machine plate body formed from an elastic material into a cylindrical shape and an engagement portion projecting radially inward from an inner circumference of the machine plate body and extending in an axial direction. The machine-plate mounting device comprises a machine-plate cylinder section fixedly provided on the machine-plate drive shaft and having, on its outer circumference, a cylindrical machine-plate mounting surface on which the machine plate is mounted from a front-end side of the machine-plate drive shaft, and is configured such that the machine-plate cylinder section has, on its outer circumference, a groove for circumferential positioning into which the engagement portion of the machine plate is fitted from the front-end side of the machine-plate drive shaft, a stopper for axial positioning with which an end portion of the machine plate comes into contact, and a machine-plate fixation member which presses a portion, other than the forme area, of the machine plate mounted on the machine-plate cylinder section from a radial inside direction toward a radial outside direction so as to bring the machine plate into fixed close contact with the machine-plate mounting surface of the machine-plate cylinder section.

Herein, the term "forme area" means an area where a forme is already formed (processed area), as well as an area where a forme is to be formed and is not yet formed (area to be processed). The forme area is formed on a portion of the machine plate which comes into close contact with the machine-plate mounting surface when the machine plate is mounted on the machine-plate cylinder section.

The inner diameter of the machine plate to be mounted on the machine-plate mounting device of the present invention is slightly greater than the outer diameter of the machine-plate mounting, surface of the machine-plate cylinder section.

When the machine plate is to be attached to the machine-plate mounting device, the machine-plate fixation member is in such a state as to not press the machine plate radially outward. In this state, the machine plate is fitted, from its one end portion, to the outer circumference of the machine-plate cylinder section in such a manner that the engagement portion of the machine plate is fitted into the groove of the machine-plate cylinder section and that the one end portion of the machine plate comes into contact with the stopper. By this procedure, the machine plate is attached to the machine-plate cylinder section at a predetermined position in an accurate, simple manner. Since the inner diameter of the machine plate is greater than the outer diameter of the machine-plate mounting surface and since, when the machine plate is attached, the machine-plate fixation member is in such a state as to not press the machine plate radially outward, a clearance exists between the machine plate and the machine-plate mounting surface, so that the machine plate can be readily attached to the machine-plate cylinder section. After the machine plate is attached, the machine-plate fixation member is brought into such a state as to press the machine plate radially outward, thereby bringing the machine plate in fixed close contact with the machine-plate mounting surface. At this time, the engagement portion of the machine plate is fitted into the groove of the machine-plate cylinder section, and one end portion of the machine plate is in contact with the stopper, whereby the machine plate is positioned with respect to the circumferential direction and the axial direction of the machine plate and is fixed at the position by means of the machine-plate fixation member. Therefore, during operation, the position of the machine plate does not deviate in relation to the machine-plate cylinder section.

Preferably, the difference between the inner diameter of the machine plate and the outer diameter of the machine-plate mounting surface is as small as possible within a range at which the machine plate can be readily attached to and detached from the machine-plate cylinder section.

When the machine plate is to be detached from the machine-plate mounting device, the machine-plate fixation member is brought in such a state as to not press the machine plate radially outward. In this state, a clearance is formed between the machine plate and the machine-plate mounting surface. Thus, the machine plate can be moved in the axial direction and readily detached from one end of the machine-plate cylinder section.

Preferably, the engagement portion is formed obliquely with respect to the machine plate body such that, when the machine plate mounted on the machine-plate cylinder section is rotated, the projecting end of the engagement portion is located rearward of the root of the engagement portion with respect to the rotational direction. More preferably, the angle between the engagement portion and the machine plate body is 35 degrees to 55 degrees inclusive. Most preferably, the angle is 45 degrees. The groove of the machine-plate cylinder section is also formed obliquely in accordance with the profile of the engagement portion such that its bottom portion is located rearward of its opening portion with respect to the rotational direction.

By virtue of the above-mentioned configuration, when the machine-plate cylinder section rotates, the engagement portion bites into the groove, so that the position of the machine plate is free from deviation.

Preferably, the machine plate is formed such that: a rectangular sheet of an elastic material is formed into a cylindrical shape with opposite end portions joined together in an overlapping condition, thereby forming the cylindrical machine plate body; an end portion of the sheet located on the inner side of a joint portion is bent inward, thereby forming the engagement portion; and the forme area is provided at a predetermined portion of the outer circumferential surface of the machine plate body excluding the joint portion.

In this case, preferably, the machine-plate fixation member presses the joint portion of the machine plate.

Preferably, the bending angle of the engagement portion is greater than 90 degrees.

The "bending angle" is an angle of bending the engagement portion from a state of the flat sheet. Therefore, the angle between the engagement portion and an adjacent portion of the sheet (sheet-engagement-portion angle) is a value obtained by subtracting the bending angle from 180 degrees.

When the bending angle of the engagement portion is rendered greater than 90 degrees, the sheet-engagement-portion angle becomes smaller than 90 degrees.

Preferably, the bending angle is 125 degrees to 145 degrees inclusive (the sheet-engagement-portion angle is 55 degrees to 35 degrees inclusive). Most preferably, the bending angle is 135 degrees (the sheet-engagement-portion angle is 45 degrees).

Even in this case, preferably, the machine-plate cylinder section is rotated in such a direction that an end portion of the sheet, which is used to form the machine plate body, associated with the engagement portion becomes a rotationally leading end. By virtue of such rotation, the projecting end of the engagement portion faces rearward with respect to the rotational direction. Thus, as the machine-plate cylinder section rotates, the engagement portion bites into the groove, so that the position of the machine plate is tree from deviation.

In the above-mentioned machine-plate mounting device, for example, the machine-plate fixation member can move between a position located radially inward of and a position located radially outward of a cylindrical surface including the machine-plate mounting surface of the machine-plate cylinder section, and can be fixed at an arbitrary position located between the positions.

In this case, when the machine plate is to be attached to or detached from the machine-plate cylinder section, the machine-plate fixation member is fixed at a position located radially inward of the cylindrical surface including the machine-plate mounting surface so as to not press the machine plate. After the machine plate is attached to the machine-plate cylinder section, the machine-plate fixation member is fixed at a position located radially outward of the cylindrical surface including the machine-plate mounting surface, whereby the machine-plate fixation member presses the machine plate radially outward, thereby bringing the machine plate into close contact with the machine-plate mounting surface.

By virtue of the above-mentioned configuration, by means of merely moving the machine-plate fixation member and fixing the machine-plate fixation member at an arbitrary position, the machine plate can be readily attached, detached, or fixed.

In the above-mentioned machine-plate mounting device, for example, a portion of the outer cylindrical surface of the machine-plate cylinder section is removed along the circumferential direction, thereby forming a machine-plate fixation member mounting surface located radially inward of the cylindrical surface including the machine-plate mounting surface. Also, the machine-plate fixation member is fitted in a radially movable manner into a machine-plate fixation member reception recess formed on the machine-plate fixation member mounting surface.

In this case, preferably, the machine-plate fixation member is disposed at a circumferentially intermediate portion of the machine-plate fixation member mounting surface or rearward of the circumferentially intermediate portion with respect to the rotational direction, and the groove is provided, on the machine-plate fixation member mounting surface, frontward of the machine-plate fixation member with respect to the rotational direction.

In the above-mentioned machine-plate mounting device, for example, a wedge member having a radially outer wedge surface is fitted in an axially movable manner into a wedge member reception recess formed on the bottom of the recess of the machine-plate fixation member mounting surface; screw means is provided in the machine-plate cylinder section for axially moving the wedge member and stopping the wedge member at an axially arbitrary position; the machine-plate fixation member has a radially inner wedge surface in contact with the wedge surface of the wedge member; and urging means is provided between the machine-plate cylinder section or the wedge member and a machine-plate fixation member, for urging the machine-plate fixation member radially inward by use of permanent magnets so as to bring the wedge surface of the machine-plate fixation member in pressure contact with the wedge surface of the wedge member.

By virtue of the above-mentioned configuration, by means of merely moving the wedge member and fixing the wedge member at an arbitrary position by the screw means, the machine plate can be readily attached, detached, or fixed.

The printer of the present invention is characterized by having the above-mentioned machine-plate mounting device for a printer.

Effect of the Invention

According to the machine-plate mounting device for a printer of the present invention, and the printer of the present invention, as mentioned above, a cylindrical machine plate can be attached to and detached from the printer very easily.

DESCRIPTION OF REFERENCE NUMERALS

Figure 1:
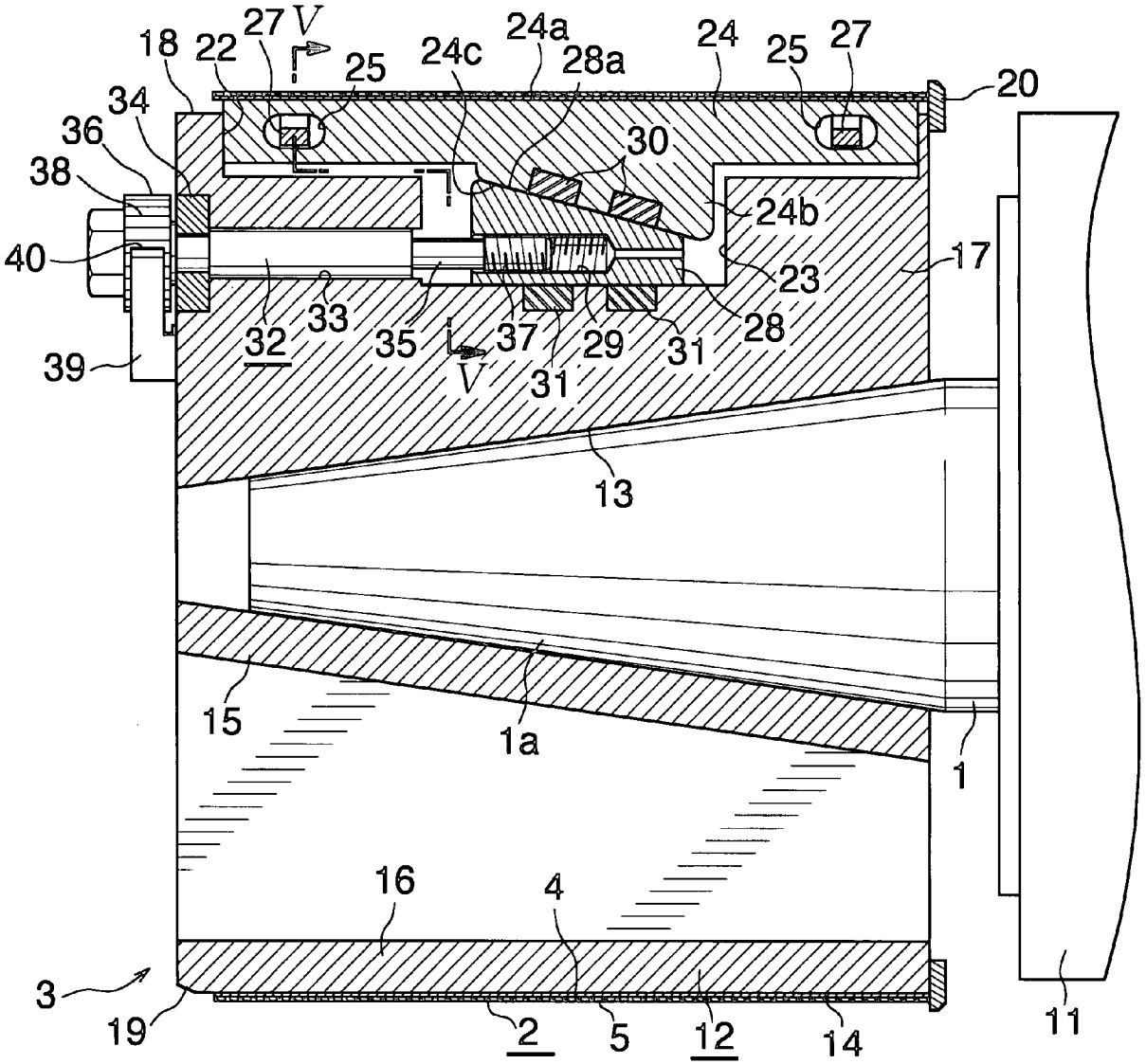
FIG. 1 is a vertical sectional view of a machine-plate mounting device for a printer according to an embodiment of the present invention.

1: machine-plate drive shaft
2: machine plate
3: machine-plate mounting device
4: machine plate body
5: forme area
6: engagement portion
12: machine-plate cylinder section
14: machine-plate mounting surface
18: machine-plate fixation member mounting surface
20: stopper for axial positioning
22: first recess (machine-plate fixation member reception recess)
23: second recess (wedge member reception recess)
21: groove for circumferential positioning
24: machine-plate fixation member
24*a*: wedge surface
28: wedge member
28*a*: wedge surface
30, 31: permanent magnet
32: screw member

MODES FOR CARRYING OUT THE INVENTION

An embodiment of the present invention will next be described with reference to the drawings.

Figure 2:
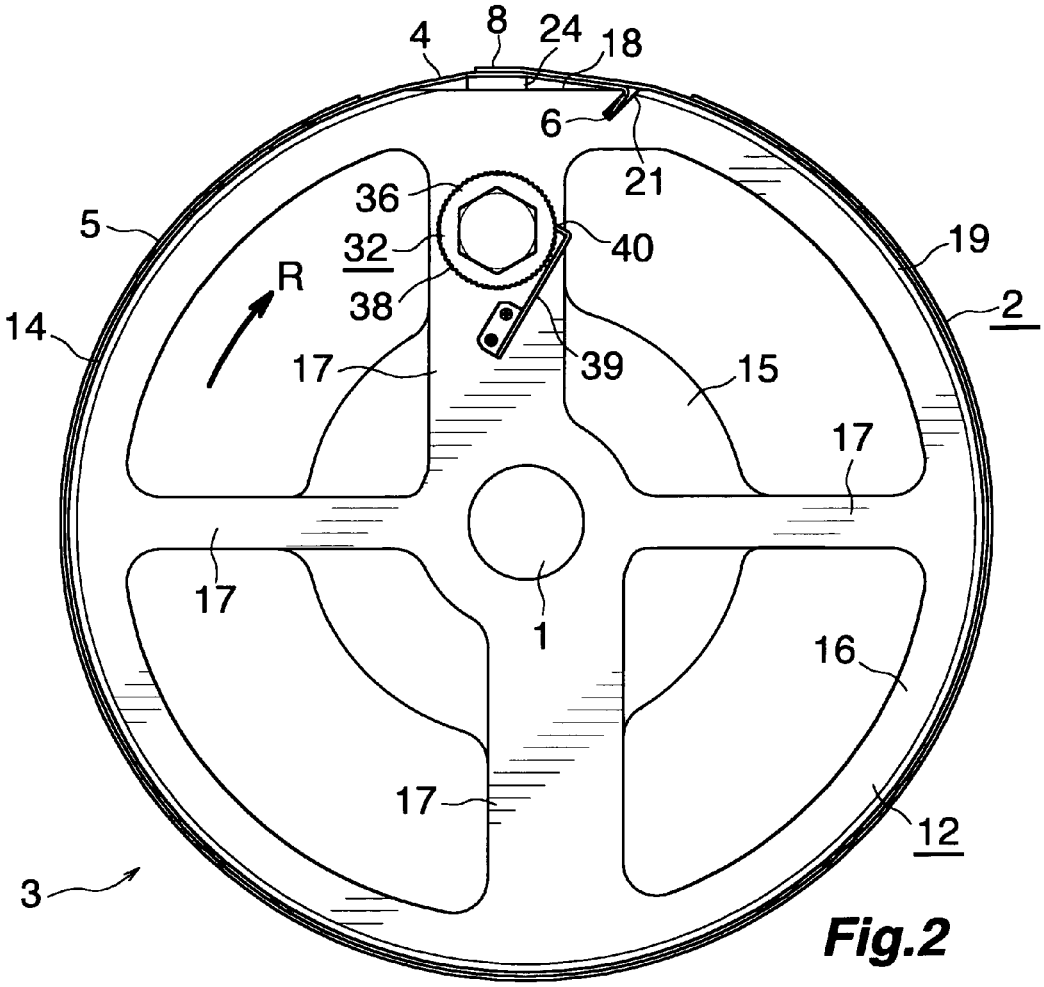
FIG. 2 is a front view of the machine-plate mounting device.
Figure 3:
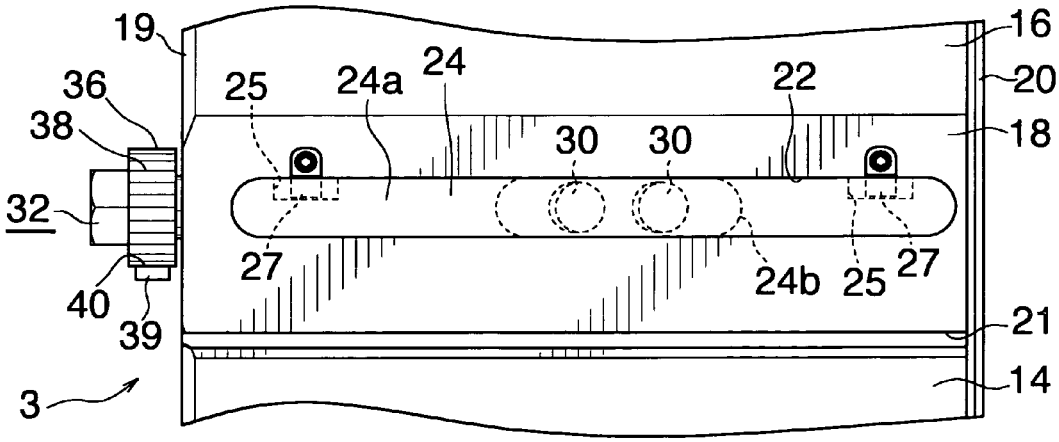
FIG. 3 is a plan view showing a portion of the machine-plate mounting device.
Figure 4:
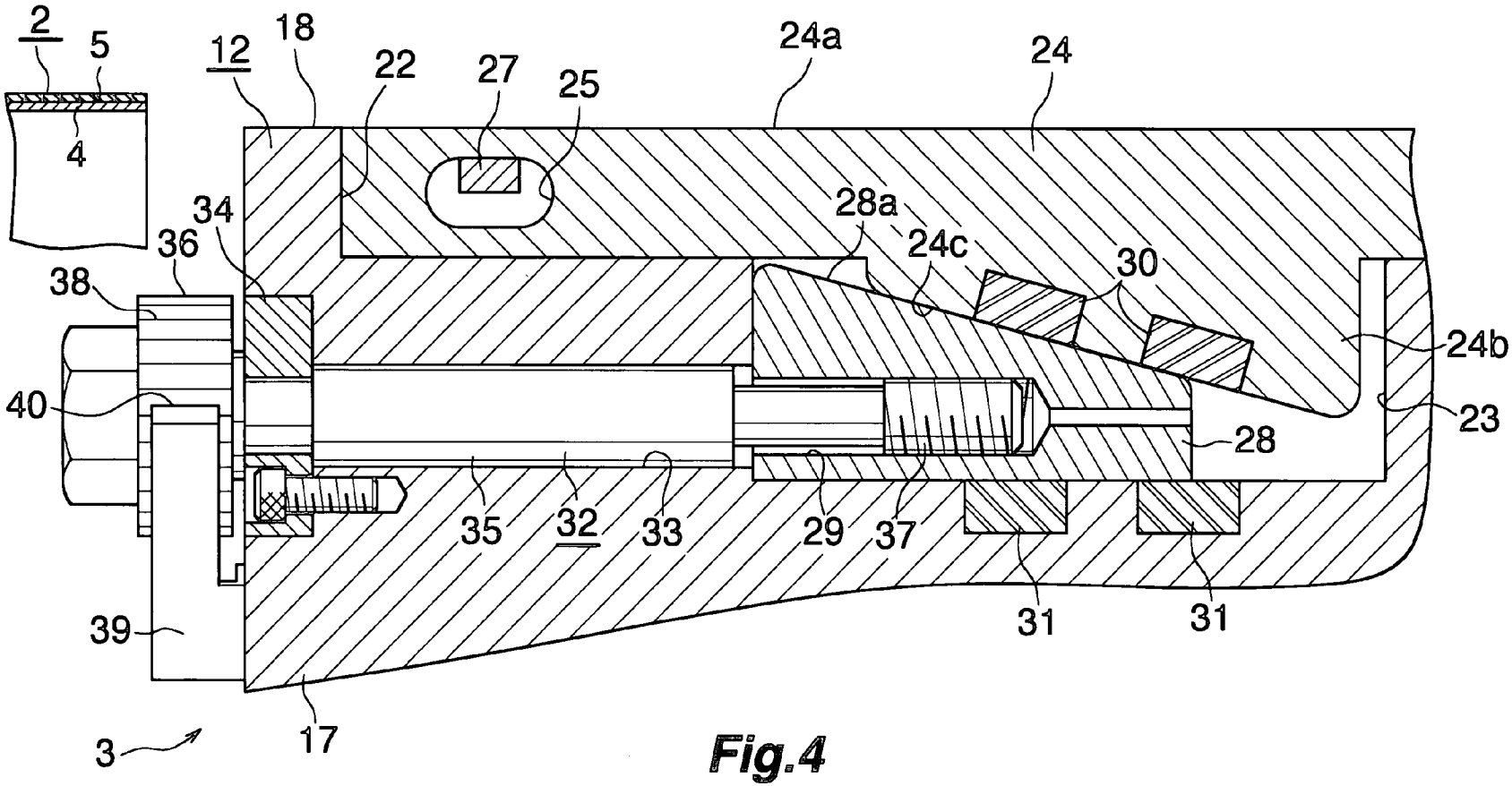
FIG. 4 is a vertical sectional view showing, on an enlarged scale, a portion of the machine-plate mounting device and a portion of a machine plate as viewed before the machine plate is mounted on the machine-plate mounting device.
Figure 5:
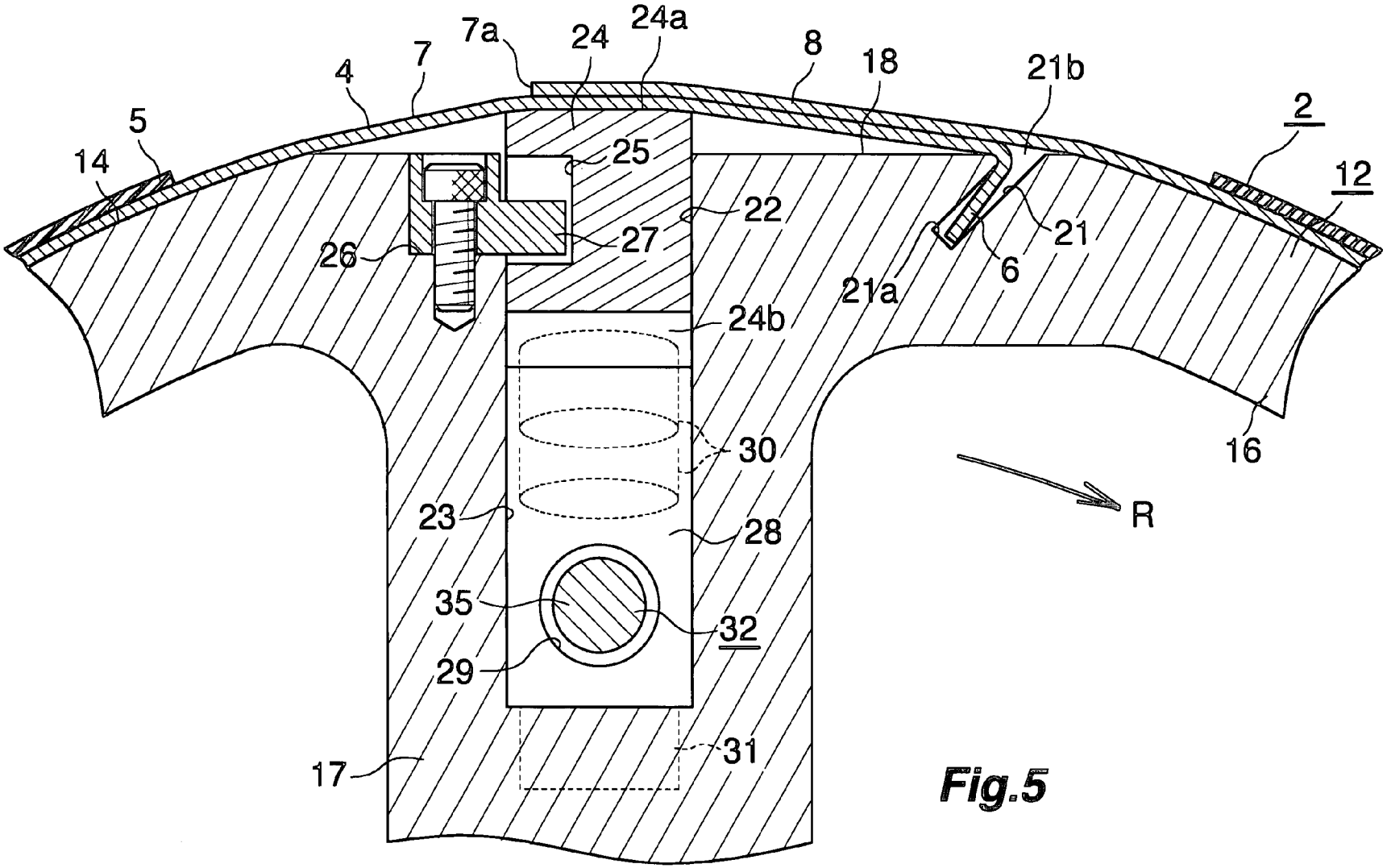
FIG. 5 is a sectional view (cross-sectional view) taken along line of FIG. 1.
Figure 6:
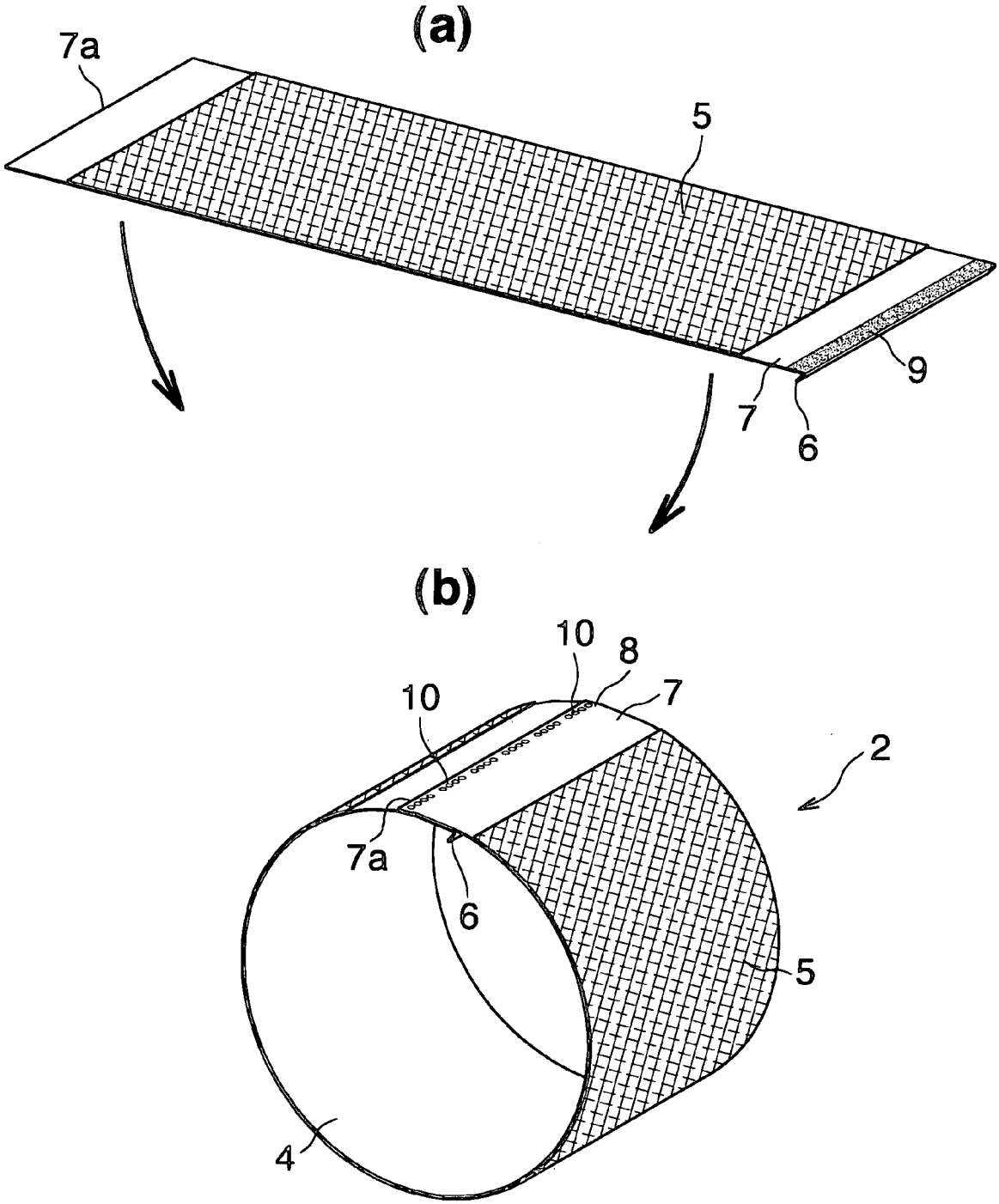
FIG. 6 is a pair of perspective views showing a machine plate and a machine-plate manufacturing step.
Figure 7:
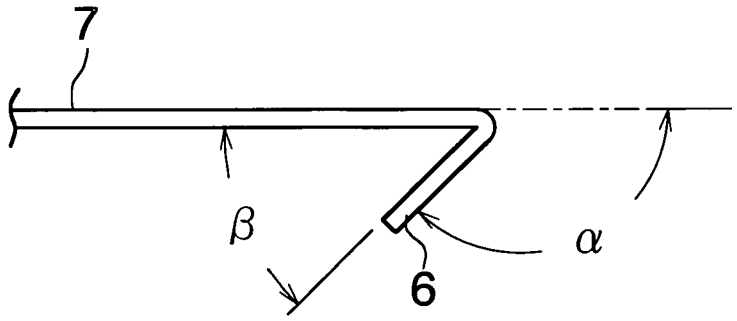
FIG. 7 is a side view showing, on an enlarged scale, a portion of a sheet as viewed before formation of the machine plate of FIG. 6.

FIG. 1 is a vertical sectional view of a machine-plate mounting device 3 which is attached to a machine-plate drive shaft 1 of a printer and on which a machine plate 2 is mounted. FIG. 2 is a front view of the machine-plate mounting device 3 of FIG. 1. FIG. 3 is a plan view showing a portion of the machine-plate mounting device 3. FIG. 4 is a vertical sectional view showing, on an enlarged scale, a portion of the machine-plate mounting device 3 and a portion of the machine plate 2 as viewed before the machine plate 2 is mounted on the machine-plate mounting device 3. FIG. 5 is a sectional view (cross-sectional view) taken along line V-V of FIG. 1. FIG. 6 is a pair of perspective views showing the machine plate 2 and a machine-plate manufacturing step. FIG. 7 is a side view showing, on an enlarged scale, a portion of a sheet as viewed before formation of the machine plate of FIG. 6. In the following description, the upper and lower sides of FIG. 1 will be referred to as "upper" and "lower," respectively. The left-hand and right-hand sides of FIG. 1 will be referred to as "front" and "rear," respectively. The left-hand and right-hand sides as viewed from the front toward the rear will be referred to as "left" and "right," respectively.

The machine plate 2 has a forme area 5 provided on a portion of the outer circumferential surface of a machine plate body 4 which is formed from an elastic material into a cylindrical shape, and an engagement portion 6 projecting radially inward from the inner circumference of the machine plate body 4 and extending in the axial direction. In this example, as shown in FIG. 6(*b*), the machine plate 2 is formed such that: a rectangular sheet 7 of an elastic material is formed into a cylindrical shape with its opposite end portions joined together in an overlapping condition, thereby forming the cylindrical machine plate body 4; an end portion of the sheet 7 located on the inner side of a joint portion 8 is bent inward, thereby forming the engagement portion 6; and the forme area 5 is provided at a predetermined portion of the outer circumferential surface of the machine plate body 4 excluding the joint portion 8. The machine plate body 4 is formed from an appropriate magnetic or nonmagnetic metal. In this example, SS steel, which is a general structural steel, is used to form the machine plate body 4. The thickness of the sheet 7 may be such that the sheet 7 can be formed into a cylindrical shape and such that the cylindrical shape can be maintained by an elastic force. In this example, the thickness of the sheet 7 is about 0.24 mm. A joining means for the sheet 7 is arbitrary. In this example, an adhesive and spot welding are used as the joining means.

The forme area 5 is provided at a predetermined portion of the outer circumferential surface of the machine plate body 4 excluding the joint portion 8.

An end portion of the sheet 7 located on the inner side of the joint portion 8 is bent inward, thereby forming the engagement portion 6. In FIG. 7, an angle $\alpha$ at which the engagement portion 6 is actually bent from a flat state of the sheet 7 represented by the chain line is called the bending angle, and an angle $\beta$ between the engagement portion 6 and an adjacent portion of the sheet 7 is called the sheet-engagement-portion angle. The bending angle $\alpha$ is preferably greater than 90 degrees (the sheet-engagement-portion angle $\beta$ is less than 90 degrees), more preferably 125 degrees to 145 degrees inclusive (the sheet-engagement-portion angle $\beta$ is 55 degrees to 35 degrees inclusive), most preferably 135 degrees (the sheet-engagement-portion angle $\beta$ is 45 degrees). In this example, the bending angle $\alpha$ is about 135 degrees, and the sheet-engagement-portion angle $\beta$ is about 45 degrees.

A method of manufacturing the machine plate 2 is arbitrary. Next, an example method of manufacturing the machine plate 2 will be described with reference to FIG. 6.

First, as shown in FIG. 6(*a*), the engagement portion 6 is formed at an end portion of the rectangular sheet 7, and the forme area 5 is formed at a predetermined portion of the sheet 7 excluding opposite end portions. Then, an appropriate adhesive 9 is applied to the surface of an end portion of the sheet 7 associated with the engagement portion 6, the surface being located on a side opposite the engagement portion 6. Next, as shown in FIG. 6(*b*), the sheet 7 is formed into a cylindrical shape; an opposite end portion 7*a* of the sheet 7 is externally overlaid on the adhesive 9 for joining; and joining of the joint portion 8 is enhanced by spot welding. In FIG. 6(*b*), reference numeral 10 denotes spot-welded zones. Forming a forme in the forme area 5; i.e., a forme-making process, may be performed on the forme area 5 of the sheet 7 of FIG. 6(*a*) or on the forme area 5 of the cylindrical machine plate 2 of FIG. 6(*b*).

Next, the configuration of the Machine-plate mounting device 3 will be described with reference to FIGS. 1 to 5.

In FIG. 1, reference numeral 11 denotes a bearing housing provided in an unillustrated machine frame of the printer. A front portion of the machine-plate drive shaft 1 is supported rotatably by the bearing housing 11, and a rear portion of the machine-plate drive shaft 1 is supported rotatably by an unillustrated bearing housing provided in the machine frame. The machine-plate drive shaft 1 is rotated in a predetermined direction (in this example, clockwise as viewed from the front side) at a predetermined speed by a known drive means. A portion of the machine-plate drive shaft 1 located toward the front end of the shaft 1 projects frontward from the bearing housing 11. A front end portion of the shaft 1 located frontward of the bearing housing 11 is formed into a taper portion 1*a*.

The machine-plate mounting device 3 is removably fixed on the shaft taper portion 1*a*.

The machine-plate mounting device 3 includes a machine-plate cylinder section 12 to be fixed on the shaft taper portion 1*a*. The machine-plate cylinder section 12 has a taper hole 13, which is formed at its center and whose diameter reduces frontward, and assumes a cylindrical shape. The machine-plate cylinder section 12 also has a cylindrical machine-plate mounting surface 14, which is formed on its outer circumference and is concentric with the machine-plate drive shaft 1. In order to reduce weight, there are removed a plurality of (in this example, four) portions of the machine-plate cylinder section 12 which are located circumferentially and extend along the entire length in the front-rear direction. Thus, the machine-plate cylinder section 12 includes a taper tubular portion 15 having the taper hole 13 formed therein; an outer cylindrical portion 16 having the machine-plate mounting surface 14 formed on its outer circumference; and a plurality of (in this example, four) connection portions 17, which connect the taper tubular portion 15 and the outer cylindrical portion 16 together. The machine-plate cylinder section 12 is fixed on the shaft 1 in such a state that the taper hole 13 is fitted to the shaft taper portion 1*a*, and rotates together with the machine-plate drive shaft 1. In FIGS. 2 and 5, the rotational direction of the machine-plate cylinder section 12 is indicated by arrow R.

At a portion of the outer cylindrical portion 16 of the machine-plate cylinder section 12 corresponding to the upper connection portion 17, a portion of the cylindrical surface is removed so as to form a flat, machine-plate fixation member mounting surface 18. The outer circumference of the outer cylindrical portion 16 excluding the machine-plate fixation member mounting surface 18 serves as the machine-plate mounting surface 14. The forme area 5 of the machine plate 2 is formed at a portion of the machine plate body 4 which comes in close contact with the machine-plate mounting surface 14 when the machine plate 2 is mounted on the machine-plate cylinder section 12. The circumferential length of the machine-plate mounting surface 14 is longer than that of the forme area 5. The machine-plate fixation member mounting surface 18 is located radially inward of the cylindrical surface including the machine-plate mounting surface 14. A taper surface 19 is formed, by chamfering, at a front end portion of the machine-plate mounting surface 14. The outer diameter of the machine-plate mounting surface 14 is slightly smaller than the inner diameter of the machine plate 2.

An annular stopper 20 for axial positioning is fixed to an outer circumferential portion of the rear end surface of the outer cylindrical portion 16 of the machine-plate cylinder section 12 in such a manner as to slightly project radially outward beyond the machine-plate mounting surface 14.

A groove 21 for circumferential positioning into which the engagement portion 6 of the machine plate 2 is fitted is formed at a front end portion, with respect to the rotational direction, of the machine-plate fixation member mounting surface 18 in such a manner as to extend along the overall axial length. The angle between the groove 21 and the cylindrical surface including the machine-plate mounting surface 14 is equal to the sheet-engagement-portion angle β of the engagement portion 6 of the machine plate 2. The groove 21 is formed such that its bottom portion 21*a* is located rearward of its opening portion 21*b* with respect to the rotational direction.

A first recess (machine-plate fixation member reception recess) 22 is formed at a portion of the machine-plate fixation member mounting surface 18 which is located rearward of the groove 21 with respect to the rotational direction; in this example, at a portion of the machine-plate fixation member mounting surface 18 which is located rearward, with respect to the rotational direction, of a circumferentially intermediate portion of the machine-plate fixation member mounting surface 18. As viewed from the radially outer side, the recess 22 assumes such a rectangular shape that extends along almost all the axial length of the machine-plate fixation member mounting surface 18. The recess 22 has a rectangular cross-sectional shape. The recess 22 has a flat bottom wall and two flat side walls. A second recess (wedge member reception recess) 23 shorter than the first recess 22 is formed at a longitudinally intermediate portion of the first recess 22 in such a manner that a portion of the first recess 22 is extended radially inward. The second recess 23 has a rectangular cross-sectional shape as well as a flat bottom wall and two flat side walls.

A machine-plate fixation member 24, which is elongated in the front-rear direction, is fitted into the first recess 22 in such a manner as to be movable in the radial direction of the shaft 1. The machine-plate fixation member 24 is fitted into the recess 22 with almost no clearance being left in the circumferential direction and in the axial direction and moves in a radial direction along the two circumferential side walls and two axial end walls of the recess 22. A radially outer end surface 24*a* of the machine-plate fixation member 24 is a flat surface parallel with the machine-plate fixation member mounting surface 18. The end surface 24*a* may be a cylindrical surface having the same radius of curvature as that of the machine-plate mounting surface 14. The machine-plate fixation member 24 has a projection 24*b*, which is formed on its radially inner end surface at an axially intermediate portion in such a manner as to project radially inward and which is fitted into a radially outer portion of the second recess 23. The radially inner end surface of the projection 24*b* serves as a wedge surface 24*c* which faces frontward and radially inward. A rectangular groove 25 is formed at each of two; i.e., front and rear, positions on one side wall of the machine-plate fixation member 24. A cutout portion 26 is formed at each of two; i.e., front and rear, positions on one side wall of the recess 22. Detachment prevention members 27 are fixed to the respective cutout portions 26 in such a manner that their end portions project into the recess 22. The detachment prevention members 27 are fitted into the respective grooves 25 of the machine-plate fixation member 24 with a clearance present in each of the front-rear direction and the radial direction, thereby allowing radial movement of the machine-plate fixation member 24 while preventing detachment of the machine-plate fixation member 24.

A wedge member 28 is fitted into the second recess 23 in such a manner as to be movable in the front-rear direction. The radially inner end surface of the wedge member 28 is a flat surface in slidable contact with the bottom wall of the recess 23. The wedge member 28 is fitted into the recess 23 with almost no clearance left in the circumferential direction and moves in the front-rear direction along the bottom wall and the two side walls of the recess 23. The radially outer end surface of the wedge member 28 serves as a wedge surface 28*a*, which faces rearward and radially outward in such a manner as to face the wedge surface 24*c* of the machine-plate fixation member 24. The wedge member 24 has internal threads 29 provided rearward from its front end surface.

First permanent magnets 30 are fixedly embedded in the wedge surface 24*c* of the machine-plate fixation member 24.

Second permanent magnets 31 facing toward the first permanent magnets 30 are fixedly embedded in the bottom wall of the second recess 23. The first permanent magnets 30 and the second permanent magnets 31 are disposed in such a manner as to attract each other, and constitute urging means for urging the machine-plate fixation member 24 radially inward by means of the magnetic attraction so as to bring the wedge surface 24*c* of the machine-plate fixation member 24 in pressure contact with the wedge surface 28*a* of the wedge member 28.

A screw member 32 extends in the front-rear direction through the wall of the connection portion 17 located frontward of the second recess 23. The screw member 32 is supported in such a manner as to be rotatable but immovable in the front-rear direction, by a hole 33 extending through the wall of the connection portion 17 in the front-rear direction and a bearing member 34 fixed in the front end surface of the wall of the connection portion 17. The screw member 32 includes a screw portion 35 supported by the hole 33 of the connection portion 17 and the bearing member 34, and a head piece 36, which is fixed to the front end of the screw portion 35 after the screw portion 35 is fitted through the bearing member 34. The screw portion 35 is supported by the hole 33 of the connection portion 17 and the bearing member 34. A rear portion of the screw portion 35 which extends into the second recess 23 has external threads 37 formed thereon. The external threads 37 are engaged with the internal threads 29 of the wedge member 28. The head piece 36 projects frontward of the connection portion 17 and has a large number of axially extending fine whirl-stop teeth 38 on its outer circumferential surface. A base end portion of a whirl-stop member 39 is fixed on the front end surface of the connection portion 17. The whirl-stop member 39 is formed of an elastic member, such as a metal plate. A pawl 40 formed at a free end portion of the whirl-stop member 39 is brought into pressure contact with a portion between adjacent teeth 38 formed on the outer circumferential surface of the head piece 36 of the screw member 32, thereby performing a function of stopping whirl of the screw member 32.

When the screw member 32 is rotated in a pressing direction, the wedge member 28 moves toward a pressing side (rearward); accordingly, the machine-plate fixation member 24 moves toward a pressing side (radially outward). When the screw member 32 is rotated in the reverse direction; i.e., in the press cancellation direction, the wedge member 28 moves toward a press cancellation side (frontward); accordingly, the machine-plate fixation member 24 moves toward a press cancellation side (radially inward). When the machine-plate fixation member 24 moves toward the pressing side to the farthest extent, the machine-plate fixation member 24 projects radially outward beyond the cylindrical surface including the machine-plate mounting surface 14. When the machine-plate fixation member 24 moves toward the press cancellation side to the farthest extent, the machine-plate fixation member 24 sinks radially inward under the cylindrical surface including the machine-plate mounting surface 14. The screw member 32 and the internal threads 29 of the wedge member 28 constitute screw means for axially moving the wedge member 28 and fixing the wedge member 28 at an axially arbitrary position.

When the machine plate 2 is to be attached to the above-mentioned machine-plate mounting device 3, the machine-plate fixation member 24 is fixed at a sunken position where the machine-plate fixation member 24 is sunk radially inward under the cylindrical surface including the machine-plate mounting surface 14, thereby being brought into a press cancellation state in which the machine-plate fixation member 24 does not press the machine plate 2. In this state, the machine plate 2 is fitted, from its one end portion, to the outer circumference of the machine-plate cylinder section 12 in such a manner that the engagement portion 6 of the machine plate 2 is fitted into the groove 21 of the machine-plate cylinder section 12 and that the one end portion of the machine plate 2 comes into contact with the stopper 20. By this procedure, the machine plate 2 is attached to the machine-plate cylinder section 12 at a predetermined position in an accurate, simple manner. Since the inner diameter of the machine plate 2 is greater than the outer diameter of the machine-plate mounting surface 14 and since, when the machine plate 2 is attached, the machine-plate fixation member 24 is located at the sunken position, a clearance exists between the machine plate 2 and the machine-plate mounting surface 14 and between the machine plate 2 and the machine-plate fixation member 24, so that the machine plate 2 can be readily attached to the machine-plate cylinder section 12. Upon attachment of the machine plate 2, the screw member 32 is rotated in the pressing direction so as to move the machine-plate fixation member 24 in the pressing direction. By this procedure, the machine-plate fixation member 24 is pressed against the inner circumference of the joint portion 8 of the machine plate 2, thereby bringing the machine-plate fixation member 24 into a pressing state in which the machine-plate fixation member 24 presses the machine plate 2 radially outward. When the machine-plate fixation member 24 applies a predetermined tensile force to the machine plate 2, and thus the machine plate 2 is brought in fixed close contact with the machine-plate mounting surface 14, the screw member 32 is stopped rotating and is fixed at the position by means of the whirl-stop member 39. Mounting of the machine plate 2 is thus completed. At this time, the entire frame area 5 is in close contact with the machine-plate mounting surface 14 via the machine-plate body 4.

During printing, the machine-plate cylinder section 12 is rotated in a state in which the machine plate 2 is fixed on the machine-plate cylinder section 12 as mentioned above. At this time, the machine plate 2 is brought in fixed close contact with the machine-plate mounting surface 14 by means of the machine-plate fixation member 24; furthermore, the projecting end of the engagement portion 6 of the machine plate 2 faces rearward with respect to the rotational direction R. Thus, the engagement portion 6 bites into the groove 21, so that the position of the machine plate 2 does not deviate. Also, since the claw 40 of the whirl-stop member 39 bites into a portion between adjacent teeth 38 of the head piece 36 of the screw member 32 by the effect of an elastic force, the screw member 32 is free from rotation which could otherwise result from subjection to vibration.

When the machine plate 2 which is mounted on the machine-plate cylinder section 12 as mentioned above is to be detached, the screw member 32 is rotated in the press cancellation direction so as to move the machine-plate fixation member 24 in the press cancellation direction. Then, the machine-plate fixation member 24 is fixed at the sunken position. By this procedure, a clearance is formed between the machine plate 2 and the machine-plate mounting surface 14 and between the machine plate 2 and the machine-plate fixation member 24. Thus, by means of axially moving the machine plate 2, the machine plate 2 can be readily detached from one end of the machine-plate cylinder section 12.

The overall and component-level configurations of the printer, the machine-plate mounting device 3, and the machine plate 2 are not limited to those of the above-described embodiment and may be modified as appropriate.

For example, the machine plate may be such that a separately made engagement piece, which serves as the engagement portion, is fixed to the cylindrical machine-plate body.

In the above-described embodiment, the screw member 32 is manually rotated, but may be rotated by means of motive power, such as electric power.

In the above-described embodiment, the machine-plate fixation member is moved radially by means of axial movement of the wedge member. However, the machine-plate fixation member may be directly moved in a radial direction by manual operation or by means of motive power. Also, in the above-described embodiment, the machine plate 2 is pressed from the radial inside direction toward the radial outside direction by means of radial movement of the machine-plate fixation member. However, for example, the machine plate 2 may be pressed from the radial inside direction toward the radial outside direction by means of rotation of an eccentric fixation member.

INDUSTRIAL APPLICABILITY

The present invention is suitably applied to a machine-plate mounting device for a printer, as well as to a printer. By use of a machine-plate mounting device for a printer according to the present invention and a printer according to the present invention, a cylindrical machine plate can be attached to and detached from the printer very easily.

The invention claimed is:

1. A machine-plate mounting device for a printer which is fixedly provided on a machine-plate drive shaft of the printer for mounting a machine plate having a forme area provided on a portion of an outer circumferential surface of a machine plate body formed from an elastic material into a cylindrical shape and an engagement portion projecting radially inward from an inner circumference of the machine plate body and extending in an axial direction, the machine-plate mounting device comprising a machine-plate cylinder section fixedly provided on the machine-plate drive shaft and having, on its outer circumference, a cylindrical machine-plate mounting surface on which the machine plate is mounted from a front-end side of the machine-plate drive shaft, and being configured such that the machine-plate cylinder section has, on its outer circumference, a groove for circumferential positioning into which the engagement portion of the machine plate is fitted from the front-end side of the machine-plate drive shaft, a stopper fixedly mounted on a back-end side of the machine-plate cylinder section, the stopper for axial positioning of the machine plate on the machine-plate cylinder section at a predetermined axial position, wherein the stopper defines a radial surface that an end portion of the machine plate banks against to set the predetermined axial position of the machine plate, and a machine-plate fixation member which presses a portion, other than the forme area, of the machine plate mounted on the machine-plate cylinder section from a radial inside direction toward a radial outside direction so as to bring the machine plate into fixed close contact with the machine-plate mounting surface of the machine-plate cylinder section, wherein the engagement portion is formed obliquely with respect to the machine plate body such that, when the machine plate mounted on the machine-plate cylinder section is rotated, the projecting end of the engagement portion is located rearward of the root of the engagement portion with respect to the rotational direction, and the groove of the machine-plate cylinder section is also formed obliquely in accordance with the profile of the engagement portion such that its bottom portion is located rearward of it opening portion with respect to the rotational direction, wherein:

the machine-plate fixation member can move between a position located radially inward of and a position located radially outward of a cylindrical surface including the machine-plate mounting surface of the machine-plate cylinder section, and can be fixed at an arbitrary position located between the positions;

a portion of the cylindrical surface on the outer circumference of the machine-plate cylinder section is removed along a circumferential direction, thereby forming a machine-plate fixation member mounting surface located radially inward of the cylindrical surface including the machine-plate mounting surface, and the machine-plate fixation member is fitted in a radially movable manner into a machine-plate fixation member reception recess formed on the machine-plate fixation member mounting surface; and a wedge member having a radially outer wedge surface is fitted in an axially movable manner into a wedge member reception recess formed on the bottom of the machine-plate fixation member reception recess formed on the machine-plate fixation member mounting surface; the machine-plate fixation member has a radially inner wedge surface in contact with the wedge surface of the wedge member; and urging means is provided between the machine-plate cylinder section or the wedge member and a machine-plate fixation member, for urging the machine-plate fixation member radially inward by use of permanent magnets so as to bring the wedge surface of the machine-plate fixation member in pressure contact with the wedge surface of the wedge member.

2. A machine-plate mounting device for a printer according to claim 1, wherein screw means is provided in the machine-plate cylinder section for axially moving the wedge member and stopping the wedge member at an axially arbitrary position.

3. A printer comprising the machine-plate mounting device for a printer according to claim 1.

4. A printer comprising the machine-plate mounting device for a printer according to claim 1.

5. A printer comprising the machine-plate mounting device for a printer according to claim 1.

6. A printer comprising the machine-plate mounting device for a printer according to claim 4.

7. A machine-plate mounting device for a printer according to claim 1, wherein the machine-plate cylinder section has a sidewall defining an inward recess for receiving the machine-plate fixation member, and the stopper mounts on the sidewall.

8. A machine-plate mounting device for a printer according to claim 1, wherein the stopper is annular.

9. A machine-plate mounting device for a printer according to claim 1, wherein the engagement portion has a bend angle to the machine plate is 35 to 55 degrees.

10. A machine-plate mounting device for a printer according to claim 9, wherein the bend angle is 45 degrees.

11. A machine-plate mounting device for a printer according to claim 1, wherein the projecting end of the engagement portion is on a first end of the machine plate and located radially inward of a joint section in which a second end of the machine plate overlaps the first end.

12. A machine-plate mounting device for a printer according to claim 1, wherein the machine plate is selectively detached by axially movement.

13. A machine-plate mounting device for a printer which is fixedly provided on a machine-plate drive shaft of the printer for mounting a machine plate having a forme area provided on a portion of an outer circumferential surface of a machine plate body formed from an elastic material into a cylindrical shape and an engagement portion projecting radially inward from an inner circumference of the machine plate body and extending in an axial direction, the machine-plate mounting device comprising a machine-plate cylinder section fixedly provided on the machine-plate drive shaft and having, on its outer circumference, a cylindrical machine-plate mounting surface on which the machine plate is mounted from a front-end side of the machine-plate drive shaft, and being configured such that the machine-plate cylinder section has, on its outer circumference, a groove for circumferential positioning into which the engagement portion of the machine plate is fitted from the front-end side of the machine-plate drive shaft, a stopper for axial positioning with which an end portion of the machine plate comes into contact, and a machine-plate fixation member which presses a portion, other than the forme area, of the machine plate mounted on the machine-plate cylinder section from a radial inside direction toward a radial outside direction so as to bring the machine plate into fixed close contact with the machine-plate mounting surface of the machine-plate cylinder section, wherein the machine-plate fixation member can move between a position located radially inward of and a position located radially outward of a cylindrical surface including the machine-plate mounting surface of the machine-plate cylinder section, and can be fixed at an arbitrary position located between the positions, wherein a portion of the cylindrical surface on the outer circumference of the machine-plate cylinder section is removed along a circumferential direction, thereby forming a machine-plate fixation member mounting surface located radially inward of the cylindrical surface including the machine-plate mounting surface, and the machine-plate fixation member is fitted in a radially movable manner into a machine-plate fixation member reception recess formed on the machine-plate fixation member mounting surface, and wherein a wedge member having a radially outer wedge surface is fitted in an axially movable manner into a wedge member reception recess formed on the bottom of the machine-plate fixation member reception recess formed on the machine-plate fixation member mounting surface; screw means is provided in the machine-plate cylinder section for axially moving the wedge member and stopping the wedge member at an axially arbitrary position; the machine-plate fixation member has a radially inner wedge surface in contact with the wedge surface of the wedge member; and urging means is provided between the machine-plate cylinder section or the wedge member and a machine-plate fixation member, for urging the machine-plate fixation member radially inward by use of permanent magnets so as to bring the wedge surface of the machine-plate fixation member in pressure contact with the wedge surface of the wedge member.

14. A machine-plate mounting device for a printer according to claim 13, wherein the engagement portion is formed obliquely with respect to the machine plate body such that, when the machine plate mounted on the machine-plate cylinder section is rotated, the projecting end of the engagement portion is located rearward of the root of the engagement portion with respect to the rotational direction, and the groove of the machine-plate cylinder section is also formed obliquely in accordance with the profile of the engagement portion such that its bottom portion is located rearward of it opening portion with respect to the rotational direction.

* * * * *